United States Patent [19]

Thiel

[11] 4,105,235

[45] Aug. 8, 1978

[54] LOCK KEEPER

[76] Inventor: Frank C. Thiel, 17 Biritz Dr., St. Louis, Mo. 63137

[21] Appl. No.: 808,184

[22] Filed: Jun. 20, 1977

[51] Int. Cl.[2] ..... E05C 21/00

[52] U.S. Cl. ..... 292/341.18

[58] Field of Search ..... 292/341.18, 341.19, 292/340

[56] References Cited

U.S. PATENT DOCUMENTS

| | | | |
|---|---|---|---|
| 1,563,667 | 12/1925 | Smith | 292/341.18 |
| 2,350,635 | 6/1944 | Pendleton | 292/341.18 |
| 2,572,428 | 10/1951 | Anstine | 292/341.18 |
| 2,695,808 | 11/1954 | Manchester | 292/341.18 |
| 3,257,139 | 6/1966 | Russell et al. | 292/341.18 |
| 3,934,910 | 1/1976 | Radke | 292/346 |

FOREIGN PATENT DOCUMENTS

| | | | |
|---|---|---|---|
| 1,354,285 | 5/1974 | United Kingdom | 292/341.18 |
| 543,168 | 2/1942 | United Kingdom | 292/341.18 |

*Primary Examiner*—Richard E. Moore

*Attorney, Agent, or Firm*—Gravely, Lieder & Woodruff

[57] ABSTRACT

A lock keeper has a mounting bracket which wraps around the strike jamb on which the keeper is installed, thus enabling the keeper to be secured to the wall adjacent to the jamb by screws which extend into that wall from two directions. The bracket carries a striker plate having a bolt aperture for receiving a lock bolt projected from a door, and the striker plate is adjustable in the horizontal direction to permit precise positioning of the bolt aperture and to enable the keeper to accommodate doors of varying width.

13 Claims, 4 Drawing Figures

LOCK KEEPER

BACKGROUND OF THE INVENTION

This invention relates in general to locks and more particularly to keepers or strikes for locks.

Wood doors and door frames are widely used in residential and apartment construction for interior as well as exterior entries. While wood is attractive in appearance and easy to work, it is not from the standpoint of security ideally suited for dwelling entries.

Quite often a thief attempting to break into a home or apartment secured with a wood door and frame will merely kick in the door so-to-speak. Actually the thief delivers a heavy blow to the door in the vicinity of its lock, and usually the door frame splits under the force, thus freeing the door so that it swings inwardly on its hinges and allows the thief to gain entry to the dwelling. In this connection, most locks project a bolt from the door into the door frame to secure the door, and the door frame is normally provided with a hole and an apertured strike or keeper which surrounds the hole. The hole and the screws which hold the keeper in place weaken the door frame to the extent that it splits along the grain passing through them when the heavy blow is transmitted to the frame through the lock.

Aside from the foregoing, a door when closed fits against a stop on the door frame, and in order for the door to be secured firmly against this stop, the keeper must be installed with a considerable degree of precision. For example, if the keeper is set too close to the stop, the bolt will not throw and the door cannot be secured. On the other hand, if the keeper is set too far away from the stop, then the door does not fit tightly against the stop, enabling one to insert a credit card or other thin object between the edge of the door and the keeper to force the latch bolt back and thereby gain entry. Furthermore doors or frames sometimes warp, and as a result the keeper must be reset, but this is difficult and often weakens the frame still further. Thus, the installation of a lock, and particularly its keeper, requires a considerable amount of carpentry skill.

SUMMARY OF THE INVENTION

One of the principal objects of the present invention is to provide a lock keeper which enables the door frame on which it is mounted to withstand substantial impacts so that the door in that frame is not easily kicked in. Another object is to provide a keeper which wraps around the strike jamb of the door frame so as to rigidify the door frame instead of weakening it. An additional object is to provide a keeper which is secured in place with screws extended firmly to the door frame. Still another object is to provide a keeper having an apertured plate which may be adjusted backwardly and forwardly, thus eliminating the necessity for a high degree of precision during installation and providing a means for accommodating door warpage. Yet another object is to provide a keeper which is attractive in appearance, durable in construction, and easy to install. These and other objects and advantages will become apparent hereinafter.

The present invention is embodied in a keeper having a mounting bracket which is configured to wrap partially around a door frame, a striker plate which is shiftable on the bracket and is capable or receiving a lock bolt, an means for securing the striker plate in a fixed position on the bracket. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
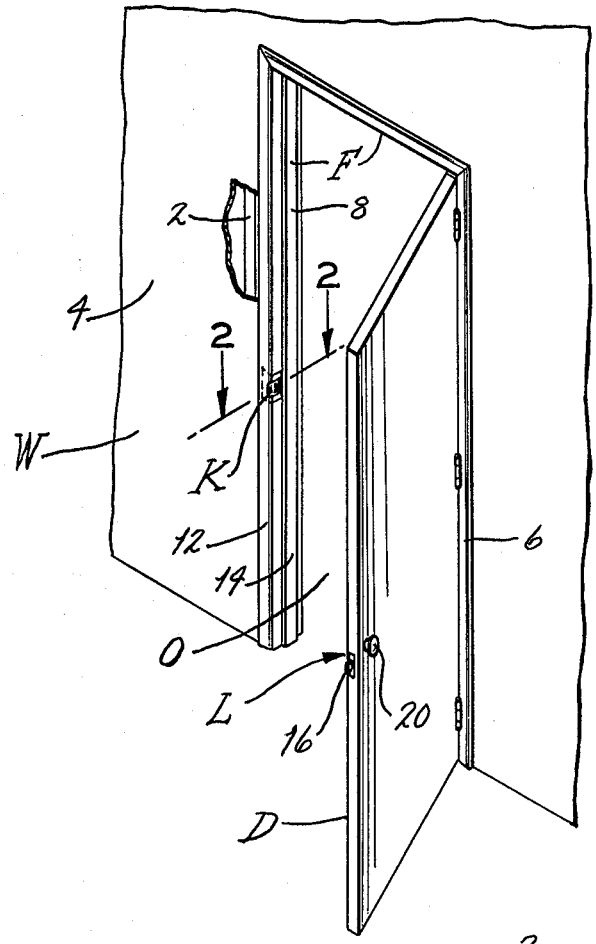
FIG. 1 is a perspective view of a wall containing a door frame provided with the lock keeper of the present invention.

Referring now to the drawings (FIG. 1), W designates a wall containing an opening O which is framed by a door frame F having a door D hung on it. The door D moves between open and closed positions with respect to the opening O and is provided with a lock L for securing it in the closed position. The lock L engages a keeper K on door frame F.

The construction of the wall W is not critical, for the keeper K may be used in conjunction with walls of a wide variety of constructions. It is particularly suitable for use on the wall W formed from studs 2 to which wall board 4 is nailed. Studs 2 exist on each side of the door opening O and indeed create a rough opening in which the door frame F is installed. Normally the rough opening is formed by double studs, that is two studs 2 nailed together so as to be side-by-side on each side of the opening O. The door frame F includes (FIG. 1) a hinge jamb 6 to which the door D is hinged and a strike jamb 8 to which the keeper K is fitted. The hinge and strike jambs 6 and 8 are nailed against the studs 2 along each side of the opening O and are normally spaced outwardly from those jambs 6 and 8, and the studs 2 to which they are nailed are covered with trim strips 12 (FIG. 2), these strips being nailed to the studs 2 as well as to the edges of the jambs 6 and 8. Each jamb 6 and 8 includes a stop 14, and when the door D is in its fully closed position, it fits against the stops 14. Thus, the stops 14 prevent the door D from swinging through the opening O in the reverse direction.

The lock L is mounted on the door D adjacent to its free edge, that is the edge that locates adjacent to the strike jamb 8 when the door D is closed (FIG. 1). The lock L contains a latch bolt 16 which may extend laterally from the free edge of the door D to engage the keeper K and thereby prevent the door D from opening. The bolt 16 is spring loaded outwardly and has a beveled end face. When the beveled face comes against the keeper K as the door K closes, the entire bolt 16 is cammed inwardly to a retracted condition with respect to the lock L. The lock L also has a knob 20 for manually retracting the bolt 16 to free it from the keeper K so as to enable the door D to be opened.

Figure 2:
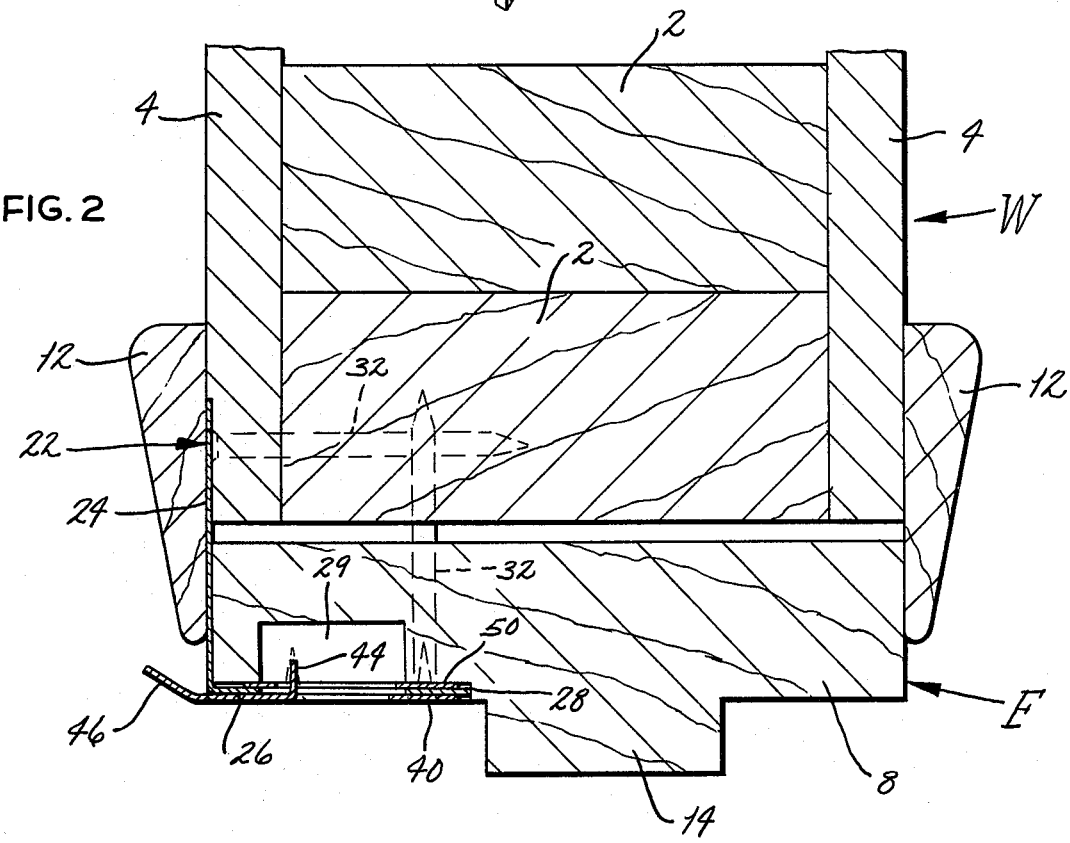
FIG. 2 is a sectional view taken along line 2—2 of FIG. 1.
Figure 4:
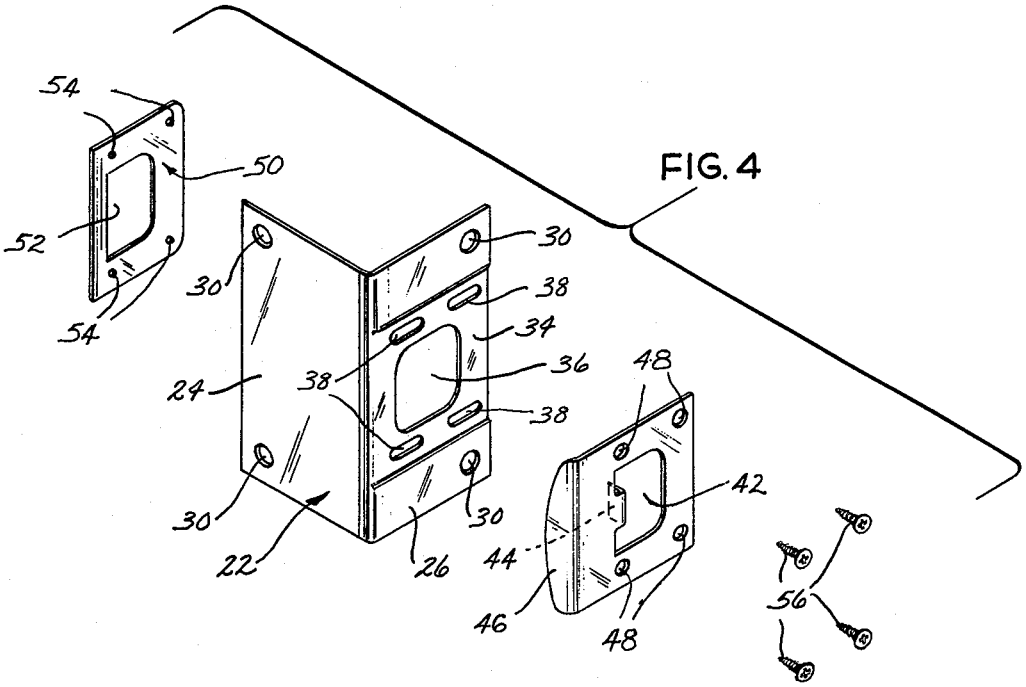
FIG. 4 is a exploded perspective view of the keeper.

The keeper K is secured to both the strike jamb 8 and the stud 2 behind that jamb and includes a mounting bracket 22 which in effect wraps around the strike jamb 8 so that a portion of it lies against that face of wall 2 out of which the door D opens (FIG. 2). More specifically the bracket 22 includes a front leg 24 and a side leg 26 and these legs 24 and 26 are disposed at a right angle with respect to each other. The front leg 24 overlies the side edge of the strike jamb 8 and the wall board 4 at the front of the wall W, yet lies behind the trim strip 12 so that it is for the most part obscured by the trim strip 12. The side leg 26 is set into a mortise 28 formed in the exposed face of the strike jamb 8 ahead of the stop 14 theron, and the mortise 28 has a large hole 29 opening out of it. The hole 29 (FIG. 2) aligns with and receives the bolt 16 when the door D is closed. Both legs 26 and 28 are provided with countersunk holes 30 (FIG. 4) near their back edges, and extended through these holes 30 are flat head wood screws 32. The screws 32 in the holes 30 of the front leg 24 pass through the wall board 4 and thread into the stud 2 located behind the wall board 4. On the other hand, the screws 32 in the side leg 26 pass through the strike jamb 8 and the space behind it and likewise thread into stud 2 to which the strike jamb 8 is nailed. The holes 30 in the leg 24 are offset in the vertical direction from the holes 30 in the leg 26 so that the screws 32 which are extended through them do not intersect within the stud 2.

The side leg 26 has a depressed portion 34 (FIG. 4) which extends the entire width thereof and forms an outwardly opening depression. Within this depression the leg 26 is provided with an enlarged aperture 36 plus a pair of elongated screw apertures 38 above the aperture 36 and another pair of elongated screw apertures 38 below the aperture 36. The aperture 36 is somewhat larger than the bolt 16 and aligns with the hole 29 in the strike jamb 8 so that when the door D is closed, the bolt 16 will project into the aperture 36 and hole 29. The screw apertures 38 are elongated in the direction transverse to the side leg 26 so that their longitudinal axes are parallel to the upper and lower margins of the depression 34.

Figure 3:
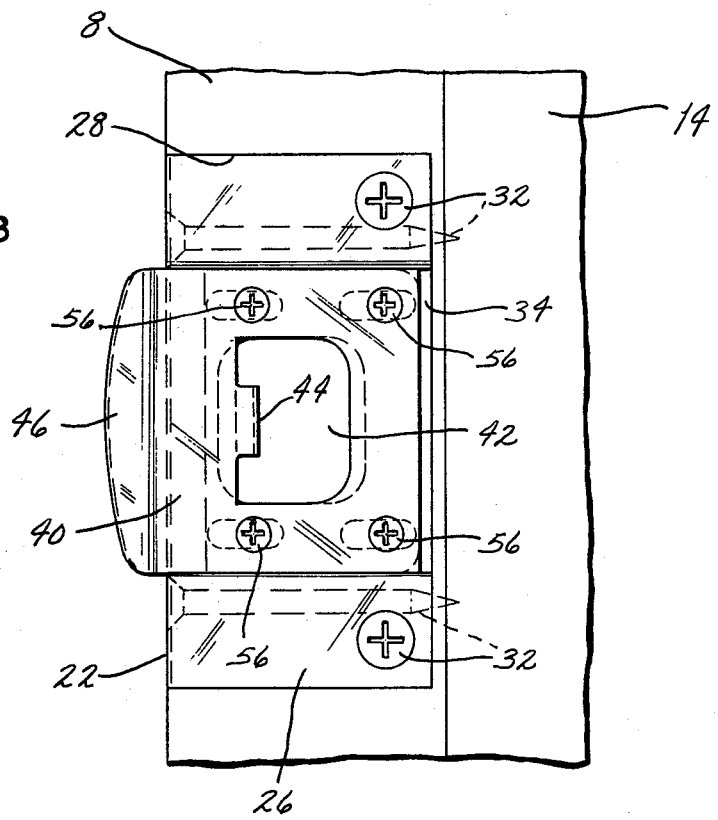
FIG. 3 is a front elevational view of the keeper.

Located within the shallow depression of the depressed portion 34 on the bracket 22 is a striker plate 40 (FIG. 3), the thickness of which is about equal to the depth of the depression so that the exposed surface of the striker plate 40 lies flush with the exposed surface areas of the side leg 26 located above and below the depressed portion 34. The striker plate 40 contains an aperture 42 which is sized and configured to receive the latch bolt 16. The aperture 42 aligns with the aperture 36 in the side leg 26 of the bracket 22, and furthermore is the same height as that aperture. Nevertheless, the aperture 42 is somewhat narrower than the aperture 36 so that the plate 40 covers portions of the latter. At the forward margin of the aperture 42, a portion of the plate 40 is turned inwardly to form a tab 44 which projects through the enlarged aperture 36 in the bracket 22. The plate 40 extends forwardly beyond the front leg 24 where it is provided with a beveled lip 46 that is turned backwardly toward the leg 24 to form a cam surface for the latch bolt 16. The beveled end face of the latch bolt 16 contacts the leg 46 as the door D is closed. Finally, the striker plate 40 is provided with four countersunk holes 48 which align with the elongated apertures in side leg 26 of the bracket 22.

Aside from the bracket 22 and the striker plate 40, the keeper K further includes a lock plate 50 which fits immediately behind the depressed portion 34 of the side leg 26 on the bracket 22. The lock plate 50 contains an aperture 52 which is about the same size as the aperture 42 in the striker plate 40, and the tab 44 from the striker plate 40 projects through the aperture 52. The lock plate 50 further has threaded holes 54 which not only align with the elongated apertures 38 in the side leg 26, but also register with the countersunk holes 48 in the striker plate 40. Extended through each set of aligned countersunk holes 48, elongated apertures 36, and threaded holes 54 are flat head metal screws 56 which are heat treated for additional strength. When turned down fully, the screws 56 clamp the striker plate 40 and lock plate 50 tightly against the depressed portion 34 of the side leg 26 on the bracket 22. In this condition, the flat heads of the screws 56 are within the countersunk holes 48 of the striker plate 40 such that the flat end faces of those screws are flush with the exposed surface of the striker plate 40. However, when the screws 56 are backed off slightly, the striker and lock plates 40 and 50 become loose and will slide horizontally on the side leg 26 of the bracket 22. Thus, the position of the bolt-receiving aperture 42 in the striker plate 40 may be adjusted forwardly and backwardly.

OPERATION

To install the keeper K on the door frame F, the strike jamb 8 of the frame F is provided with a mortise 28 (FIG. 2) immediately ahead of its stop 14, and this mortise is deep enough to accommodate the entire side leg 26 of the bracket 22. Therefore, the mortise 28 is somewhat deeper at its center to accomodate the depressed portion 34 of the side leg 26 as well as the lock plate 50 which fits against the depressed portion 34. In addition, the strike jamb 8 is provided with a relatively large hole 29 which opens out of the mortise 28 and is located opposite the latch bolt 16 when the door is closed. The hole 29 is large enough to receive the latch bolt 16 and to allow the latch bolt 16 to project to its fully extended position.

The striker plate 40 is adjusted so that the front edge of the bolt aperture 42 therein is spaced forwardly from the stop 14 a distance equal to the spacing between the front edge of the latch bolt 16 and the back face of the door D. The front edge of the bolt aperture 42 is of course located along the rearwardly presented face on the inwardly turned tab 44. The adjustment is achieved by backing the metal screws 56 off slightly and moving the striker plate 40 to the desired position.

Once the mortise 28 and hole 29 are made in the strike jamb 8 and the striker plate 40 is properly adjusted, the keeper K is installed on the strike jamb 8 with its side leg 26 set into the mortise 28. In that condition, the front leg 24 extends along the front edge of the strike jamb 8 and also over the adjacent wallboard 4. Thereupon, screws 32 are run through the two holes 30 in the side leg 26, and these screws should be sufficiently long to extend a substantial distance into the studs 2 located behind the strike jamb 8. More screws 32 are run through the holes 30 in the front leg 24, and these screws are long enough to pass completely through the wallboard 4 and into the stud 2 for a substantial distance. Thereafter, the trim strip 12 is nailed to the strike jamb 8 and stud 2 behind it, and the trim strip 12 obscures a substantial portion of the front leg 24 so that the leg 24 is not readily visible from the front of the door D.

Insofar as the reception of the latch bolt 16 is concerned, the keeper K acts in the usual manner. In particular, when the door D is moved toward its closed position, the beveled end face on the latch bolt 16 strikes the bevel lip 46 on the striker plate 40 and is cammed inwardly into its retracted position. The bolt 16 remains in this position until the front edge of the bolt 16 moves past the tab 44 on the striker plate 40, at which time the bolt 16 projects outwardly to its extended position and secures the door D. In that condition, the back face of the door D is against the stop 14 on the strike jamb 8, and the bolt 16 is received in the aligned apertures 42, 36, and 52 of the striker plate 40, side leg 26, and lock plate 50, respectively, and also in the hole 29 of the jamb 8. The knob 20 retracts the latch bolt 16 to enable the door D to be opened.

In the event an intruder attempts to kick the door in, the keeper K will offer substantially more resistance than conventional keepers since it is secured to the wall stud 2 from two directions oriented at 90° with respect to each other. Thus, it is extremely unlikely that the keeper K will be dislodged or that the strike jamb 8 will split. Consequently, the keeper K will withstand most attempts at forced entry.

While the keeper K has been described as suitable for use with the latch bolt 16, it can be used just as easily with a dead bolt, that is, a bolt having a squared off end face. That type of bolt must be manually thrown to its extended position only after the door has been closed. Also, the keeper K is suitable for use on door frames mounted in other than stud-type walls. All that is necessary is to have some material into which the screws 32 for the bracket 22 may be run.

This invention is intended to cover all changes and modifications of the example of the invention herein chosen for purposes of the disclosure which do not constitute departures from the spirit and scope of the invention.

What is claimed is:

1. A lock keeper for receiving the bolt of a mortise-type lock, said keeper comprising: an angle bracket configured to fit on a door frame and including a side leg and a front leg which are positioned at a right angle with respect to each other and are joined together at a right angle corner, the angle bracket being generally unobstructed at the inside of the corner so as to be capable of fitting against a strike jamb of a door frame with the corner of the bracket being adjacent to the edge of the door frame, the side leg having a depression opening outwardly therefrom away from the front leg with the depression extending all the way to the corner and having spaced apart margins which are substantially perpendicular to the corner, the side leg also having a bolt-receiving aperture in the depression thereof, with the aperture being configured to receive a lock bolt, the side leg further having screw-receiving apertures in the depression thereof; a striker plate fitted into the depression and being capable of sliding therein generally parallel to the margins of the depression when not secured to the angle bracket, the striker plate having a bolt aperture which aligns with the bolt-receiving aperture of the side leg on the angle bracket, the striker plate further projecting beyond the corner where it turns backwardly toward the front leg so as to form a beveled lip; a lock plate located against the opposite face of the side leg and behind the depression and being configured so as not to obstruct the bolt-receiving aperture of the side leg, whereby a lock bolt can be projected completely through striker plate and side leg and past the lock plate without interfering with the lock plate; and screws extending through the striker plate and the screw-receiving apertures in the side leg and engaging the lock plate such that when loose, the striker plate is free to slide in the depression, but when tightened the striker is clamped down tightly against the side leg and will not move, whereby it is possible to adjust the position of the bolt aperture with respect to the angle bracket.

2. A lock keeper according to claim 1 wherein the screw-receiving apertures are elongated in the direction perpendicular to the corner.

3. A lock keeper according to claim 2 wherein the screws thread into the lock plate.

4. A lock keeper according to claim 3 wherein the striker plate has a tab which projects rearwardly therefrom through the bolt-receiving aperture in the side leg and is generally parallel to the front leg.

5. In combination with a wall having a rough opening framed at least on one of its sides by a framing stud; a door frame set into the rough opening in the wall and having a hinge jamb and a strike jamb, with the strike jamb being located adjacent to and secured to the stud; a door hinged along one of its side edges to the hinge jamb so as to swing between open and closed positions with respect to the door frame, the door when in its closed position having its other side edge located opposite to the strike jamb of the door frame; and a lock on the door and having a bolt that is capable of being projected from the other side of the door or retracted into the other side edge; and improved keeper on the strike jamb of the door frame for receiving the bolt of the lock so as to secure the door in its closed position, said keeper comprising: an angled bracket having side and front legs joined together at a right angle corner, the side leg being positioned against the strike jamb and facing the side edge of the door when the door is closed, the front leg extending along that surface of the wall out of which the door opens and overlying the framing stud that forms the rough opening in the wall, the side leg having a depression which opens outwardly away from the strike jamb, with the depression being extended all the way to the corner and having spaced apart margins which are perpendicular to the corner, the side leg further having a bolt-receiving aperture in the depression, with the aperture being aligned with and configured to receive the lock bolt when the door is closed; first screws extending through the side leg and the strike jamb and into the framing stud; second screws extending through the front leg and into the framing stud; a striker plate fitted into the depression in side leg and being capable of sliding therein generally parallel to the margins of the depression when not secured to the angle bracket, the striker plate having a bolt aperture which overlies the bolt-receiving aperture of the side leg and likewise aligns with the lock bolt when the door is closed; and means for securing the striker plate in a fixed position in the depresseion of the side leg.

6. The structure according to claim 5 wherein the means for securing the striker plate comprises: a lock plate located behind the depression on the side leg and configured not to obstruct the bolt-receiving aperture in the side leg, and third screws extending through the striker plate and side leg and being threaded into the lock plate, whereby when the third screws are tightened, the striker plate is clamped firmly against the side leg.

7. The structure according to claim 6 wherein the side leg of the angle bracket has apertures in its depression, with the apertures being elongated in the direction perpendicular to the corner; and wherein the third screws pass through the elongated apertures.

8. A keeper according to claim 1 wherein the legs are oriented at substantially a right angle with respect to each other and intersect, and the striker plate slides on the first leg such that the bolt aperture therein moves toward and away from the second leg.

9. A keeper according to claim 8 wherein the first leg is provided with a depressed portion which is set inwardly with respect to the remainder of the first leg, and the striker plate overlies the depressed portion so as to be located in the depression formed thereby.

10. A keeper according to claim 8 wherein the striker plate overlies the first leg of the angle bracket; and wherein the means for securing the striker plate comprises a lock plate located behind the first leg and screws extended through the striker plate and first leg and threaded into the lock plate, so that when the screws are turned down, the striker plate is clamped tightly against the first leg.

11. A keeper according to claim 10 wherein the first leg has elongated apertures through which the screws pass, the apertures being elongated in the direction which the striker plate moves on the first leg.

12. A keeper according to claim 8 wherein the first leg of the bracket has a bolt aperture which registers with the bolt aperture in the striker plate and the striker plate has a tab which projects rearwardly through the bolt aperture of the first leg.

13. The keeper according to claim 8 wherein the striker plate projects past the second leg and beyond the second leg is turned backwardly toward that leg to form a beveled lip.

* * * * *

UNITED STATES PATENT AND TRADEMARK OFFICE

CERTIFICATE OF CORRECTION

PATENT NO. : No. 4,105,235

DATED : August 8, 1978

INVENTOR(S) : Frank C. Thiel

It is certified that error appears in the above-identified patent and that said Letters Patent are hereby corrected as shown below:

column 1, line 67, delete "an" and substitute therefore ---and--- column 5, line 65 (in claim 1) insert between "striker" and "is" ---plate--- column 6, line 21 (in claim 5) between "side" and "of" insert ---edge--- line 22 delete "and" and insert ---an--- line 28 between "the" and "side" insert ---other---

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*